US008708755B2

(12) United States Patent
Tamai

(10) Patent No.: US 8,708,755 B2
(45) Date of Patent: Apr. 29, 2014

(54) CONNECTION BLADE, INTERMEDIATE CONNECTION ELECTRICAL CONNECTOR HAVING CONNECTION BLADE, AND CONNECTION BLADE ASSEMBLY

(71) Applicant: Hirose Electric Co., Ltd., Tokyo (JP)

(72) Inventor: Nobuhiro Tamai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 13 days.

(21) Appl. No.: 13/644,192

(22) Filed: Oct. 3, 2012

(65) Prior Publication Data

US 2013/0164955 A1 Jun. 27, 2013

(30) Foreign Application Priority Data

Oct. 5, 2011 (JP) ..... 2011-220723

(51) Int. Cl.
*H01R 24/00* (2011.01)

(52) U.S. Cl.
USPC ..... 439/676; 439/941

(58) Field of Classification Search
USPC ..... 439/676, 941
See application file for complete search history.

(56) References Cited

U.S. PATENT DOCUMENTS

| | | | | |
|---|---|---|---|---|
| 8,568,177 | B2 * | 10/2013 | Bopp et al. | 439/676 |
| 8,574,014 | B2 * | 11/2013 | Mei et al. | 439/676 |
| 2010/0184307 | A1 | 7/2010 | Arai et al. | |
| 2013/0164955 | A1 * | 6/2013 | Tamai | 439/76.1 |

* cited by examiner

*Primary Examiner* — James Harvey
(74) *Attorney, Agent, or Firm* — Kubotera & Associates LLC

(57) ABSTRACT

A connection blade, an intermediate connection electrical connector and a connection blade assembly including the connection blade are provided. The connection blade includes an insulation board. The insulation board includes differential pair circuits thereon. The differential pair circuits include a straight pair and a cross pair. Both of the straight pair and the cross pair includes a parallel section where wire paths of the pair extend in parallel. In a region other than the parallel section, the cross pair includes a crossing section where wire paths thereof intersect with each other. In a region other than the parallel section, the straight pair includes a quasi-crossing section where wire paths thereof approach each other in non-contact manner so that the wire paths thereof have the same length and the same shape with that of the cross pair, thereby reducing difference of impedance and manufacturing cost.

12 Claims, 7 Drawing Sheets

CONNECTION BLADE, INTERMEDIATE CONNECTION ELECTRICAL CONNECTOR HAVING CONNECTION BLADE, AND CONNECTION BLADE ASSEMBLY

BACKGROUND OF THE INVENTION AND RELATED ART STATEMENT

The present invention relates to a connection blade, an intermediate connection electrical connector having the connection blade, and a connection blade assembly.

Patent Reference has disclosed a conventional connection blade for connecting two electrical connectors and an intermediate connection electrical connector having the connection blade.

Patent Reference: United States Patent Publication No. US2010/0184307A1

It is known that a method of differential pair signaling using two transmission paths as one pair allows signals to be transmitted at higher speed and noise to be reduced. Further, when the connection blade has signal wirings in a form of a plurality of the differential pair thereon, it is also known that a cross pair and a straight pair are arranged alternately in order to minimize crosstalk between the pairs next to each other. Patent Reference discloses the conventional connection blade described above. It is necessary to match lengths of transmission lines or path lengths between the straight pair and the cross pair so that the straight pair and the cross pair have equal electrical characteristics. In Patent Reference, the straight pair obtain the same path length with the cross pair by having a wavy shape portion through almost an entire length thereof.

In Patent Reference, the straight pair having the wavy shape portion has a far different shape from that of the cross pair having a straight line shape in most part thereof. Therefore, the straight pair and the cross pair in Patent Reference have impedance considerably different from each other. Further, when the connection blade has a small dimension in an extending direction of the signal path, that is, both of the straight pair and the cross pair has a small path length, the straight pair may not have the path length matching the cross pair if only having the wavy shape portion. When the straight pair and the cross pair are formed, by any means, to have the same path lengths with each other, the wavy portion of the straight pair needs to have a higher wave height. As a result, the straight pair requires a relatively larger region of the connection blade on which to be arranged. Therefore, when the connection blade has a number of the straight pair and the cross pair arranged thereon, the connection blade has the dimension considerably large in a direction the straight pair and the cross pair are arranged.

Furthermore, when an element (a wire path) forming the straight pair and the cross pair are formed by punching out a metal sheet, both of the straight pair and the cross pair require respective moldings since the straight pair and the cross pair have the shapes far different from each other. In addition, it is necessary to supply the molding having a blade with a complicated wavy shape for the straight pair.

In view of the problems described above, an object of the present invention is to provide a connection blade capable of solving the problems of the conventional connection blade, an intermediate connection electrical connector and a connection blade assembly including the connection blade. More specifically, a straight pair and a cross pair arranged on the connection blade have shapes which enables to share the molding for punching out and are capable of minimizing difference of impedance therebetween.

Further objects and advantages of the invention will be apparent from the following description of the invention.

SUMMARY OF THE INVENTION

In order to attain the objects described above, according to the present invention, a connection blade, an intermediate electrical connector and a connection blade assembly have configurations as described below, respectively.

According to a first aspect of the present invention, a connection blade is configured to connect at least two circuit connection portions. The connection blade includes an insulation board on which differential pair circuits are provided. The differential pair circuit includes a straight pair and a cross pair. The straight pair and the cross pair includes a pair of wire paths, respectively.

According to the first aspect of the present invention, the straight pair further includes a quasi-crossing section where one wire path thereof approaches the other wire path thereof. In a region thereof other than the quasi-crossing section is provided, the straight pair includes a parallel section where both of the wire paths thereof extends in parallel with each other. In addition, the cross pair includes a crossing section where one wire path thereof crosses over the other wire path thereof in a non-contact manner. In a region thereof other than where the crossing section is provided, the cross pair includes a parallel section where both of the wire paths thereof extends in parallel with each other. As being viewed in a direction perpendicular to the insulation board, the crossing section has a shape the same as that of the quasi-crossing section.

According to the first aspect of the present invention, the straight pair and the cross pair further include two contact points, respectively. One of the contact points of the straight pair contacts with one of the circuit connection portions and the other of the contact points contacts with the other of the circuit connection portions. Similarly, one of the contact points of the cross pair contacts with one of the circuit connection portions and the other of the contact points contacts with the other of the circuit connection portions.

According to the first aspect of the present invention, the wire paths of the straight pair have a length which is the same as that of the cross pair between the two respective contact points thereof.

In the cross pair, the one of the wire paths crosses over the other of the wire paths in a middle position thereof. On the other hand, the wire paths of the straight pair do not intersect with each other. The wire paths of the straight pair may not extend in straight lines throughout an entire region thereof.

In addition, the middle position where the crossing section of the cross pair is provided may not be situated in the center position in a longitudinal direction of the wire path. The cross pair may have the crossing section at any position between the contact points thereof.

The crossing section of the cross pair is provided in a region other than the parallel section thereof. In the crossing section, the pair of the wire paths does not extend in parallel so that the one of the wire paths crosses over the other of the wire paths thereof. The quasi-crossing section of the straight pair is provided in a region corresponding to the crossing section of the cross pair. In the quasi-crossing section, both of the wire paths thereof approach each other. Therefore, as being viewed in the direction perpendicular to the insulation board, the quasi-crossing section appears as if two wire paths thereof intersect with each other though the wire paths do not actually intersect with each other.

According to the first aspect of the present invention, in the quasi-crossing section, the straight pair further may include a curved portion where each of the wire paths is curved so as to approach each other. For example, the straight pair may include the quasi-crossing section where the wire paths does not contact with each other and a vertex of the one of the curved portion is situated at a position over that of the other curved portion as being viewed in the direction perpendicular to the insulation board.

According to the second aspect of the present invention, an intermediate connection electrical connector is configured to include one or a plurality of the connection blades according to the first aspect of the present invention. In the intermediate connection electrical connector according to the present invention, the connection blade is held by an insulation holding member. The insulation holding member has two openings. The intermediate connection electrical connector is connected to a corresponding circuit connection portion through each of the openings, thereby the contact point of the connection blade is able to contact a contact portion of the corresponding circuit connection portion.

The circuit connection portion is a portion for connecting circuits to each other, for example, an electrical connector including an insulation housing and a terminal held in the insulation housing, or a circuit board including a circuit portion to be connected and the like.

According to the third aspect of the present invention, a connection blade assembly is configured to include one or more of the connection blades. In the connection blade assembly, the connection blade is connected to at least two circuit connection portions.

The connection blade assembly according to the third aspect of the present invention includes one or plurality of the connection blades to be connected to the circuit connection portion, and an insulation holding member for holding the connection blade. In the connection blade assembly according to the third aspect of the present invention, the connection blade includes an insulation board on which differential pair circuits are provided. The differential pair circuit includes a straight pair and a cross pair. The straight pair and the cross pair are formed together on the same insulation board. The straight pair and the cross pair further include two contact points provided in both end portions thereof, respectively. The contact points contacts a wire path of the circuit connection portion in series.

The straight pair and the cross pair includes a pair of wire paths, respectively. The pair of wire paths of the straight pair do not intersect with each other while one of the wire paths of the cross pair crosses over the other of the wire paths in a middle position thereof. The straight pair includes a quasi-crossing section where the wire paths thereof approach each other. The cross pair includes a crossing section where the one of wire paths thereof crosses over the other wire path in a non-contact manner. Further, the cross pair and the straight pair include parallel sections where the wire paths thereof extend in parallel with each other, respectively. The parallel section of the straight pair is situated in a region other than the quasi-crossing section thereof. The quasi-crossing section has a shape the same as that of the crossing section as being viewed in the direction perpendicular to the insulation board.

When the connection blade is connected to the circuit connection portion, the wire paths thus connected has the same total lengths, both the total length of the wire paths including the straight pair and the total length of the wire paths including the cross pair.

In the connection blade, the intermediate connection electrical connector and the connection blade assembly according to the present invention, the straight pair and the cross pair thereof have the same shape as being viewed from the direction perpendicular to the insulation board. Therefore, when a metal sheet is punched out in order to form the wire paths of the straight pair and the cross pair, a molding having a blade portion is able to be shared as the molding is separated at a position the wire paths intersect with each other. In addition, it is possible to minimize difference of impedance between the straight pair and the cross pair when the connection blade is used.

When the parallel sections of the straight pair and the cross pair respectively have a straight wire path, the straight pair and the cross pair are both able to have simple shapes. Accordingly, the molding thereof is able to have the blade portion having a simplified shape. As a result, it is possible to reduce a manufacturing cost of the molding. In addition, it is possible to narrow a space between the wire paths, further a space between the differential pairs, enabling to downsize the connection blade in a width direction thereof. Further, as a result, it is possible to design the wire paths more freely.

When a vertex of the curved portion of one of the wire paths of the straight pair is situated at a position over that of the curved portion of the other wire path of the straight pair, the straight pair and the cross pair have the same shape with each other as being viewed in the direction perpendicular to the insulation board.

As described above, according to the present invention, the connection blade includes the straight pair and the cross pair formed on the insulation board thereof. The cross pair includes the parallel section where the wire paths thereof extend in parallel with each other in the region other than the crossing section thereof. The straight pair includes the quasi-crossing section. The quasi-crossing section of the straight pair has the same shape with the crossing section of the cross pair as being viewed in the direction perpendicular to the insulation board. The straight pair further includes the parallel section in the region other than the quasi-crossing section so that the wire path thereof has the same length with the wire path of the cross pair. Accordingly, it is possible to minimize the difference of impedance between the straight pair and the cross pair. Further, it is possible to partially share the molding for forming both of the straight pair and the cross pair. Therefore, it enables to reduce the manufacturing cost as well as improving potential for mass production.

BRIEF DESCRIPTION OF THE DRAWINGS

FIGS. 6(A) and 6(B) are schematic views showing configurations of a connection blade assembly having the connection blade shown in FIG. 5, wherein FIG. 6(A) shows one example and FIG. 6(B) shows another example; and FIGS. 7(A) and 7(B) are graphs showing test results of difference of impedance between a cross pair and a straight pair, wherein FIG. 7(A) shows an example according to the first embodiment of the present invention and FIG. 7(B) shows a comparative example.

DETAILED DESCRIPTION OF THE PREFERRED EMBODIMENTS

First embodiment

Hereunder, embodiments of the present invention will be explained with reference to the accompanying drawings.

Figure 1:
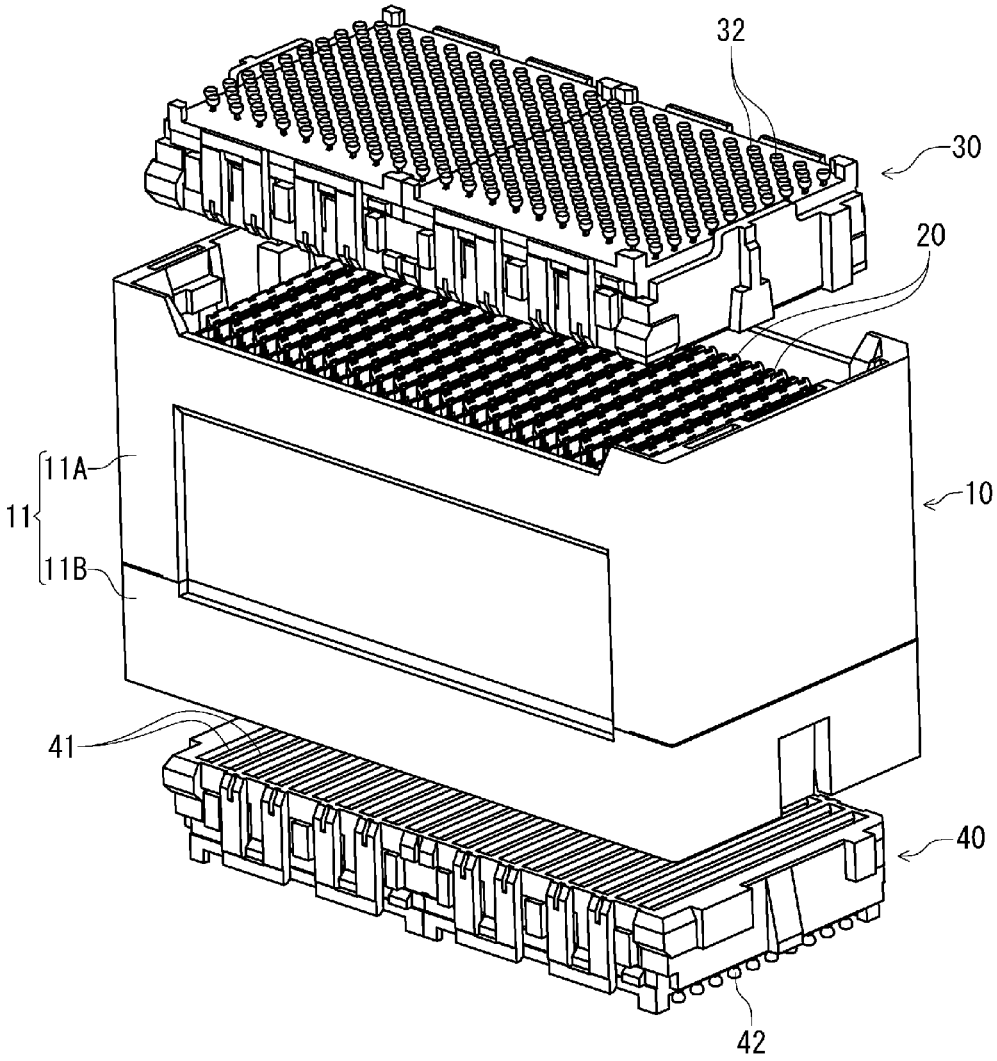
FIG. 1 is a perspective view showing an intermediate connection electrical connector having a connection blade and mating connectors to be connected thereto according to a first embodiment of the present invention, wherein the intermediate connection electrical connector is not yet connected to the mating connectors.

FIG. 1 is a perspective view showing an intermediate connection electrical connector 10 including a plurality of connection blades 20 (described later) held with an insulation holding member 11 and two mating connectors 30 and 40 to be connected to the electrical intermediate connector 10, in a state that the intermediate connection electrical connector 10 is not yet connected to the mating connectors 30 and 40.

The intermediate connection electrical connector 10 holds a connection blade group composed of the plurality of the connection blades 20. As shown in FIG. 1, the plurality of the connection blades 20 are arranged so that plate surfaces thereof are parallel with each other. Further, the plurality of the connection blades 20 are positioned and held from an upper direction and a lower direction by an upper insulation holding member 11A and a lower insulation holding member 11B of the insulation holding member 11, respectively. The insulation holding member 11 has a rectangular tube shape. Further, the insulation holding member 11 composed of the upper insulation member 11A and the lower insulation holding member 11B has fitting openings in both of the upper direction and the lower direction thereof, for receiving and connecting fitting portions of the mating connectors 30 and 40, respectively. As the mating connectors 30 and 40 are connected to the electrical intermediate connector 10, terminals (contact portions) of the mating connectors 30 and 40 contact to contact points of the connection blade 20. The mating connectors 30 and 40 have substantially the shame shape. In FIG. 1, the mating connectors 30 and 40 are situated so as to be opposite to each other with respect to a vertical direction. Each of the mating connectors 30 and 40 includes an opening slit 41 (not shown in the mating connector 30 in FIG. 1, since the opening slit 31 of the mating connector 30 faces the lower direction) as many as a number of the connecting blades 20, being situated on a side thereof facing the intermediate connection electrical connector 10. Further, on an opposite side of the opening slits 31 and 41 are situated, the mating connectors 30 and 40 have solder balls 32 and 42 being attached to the terminal, respectively. The mating connectors 30 and 40 are utilized as being soldered to corresponding circuit portions of corresponding circuit boards (not shown) with the solder balls 32 and 42 thereof, respectively. Accordingly, the mating connectors 30 and 40 are connected to each other through the intermediate connection electrical connector 10 as facing each other as shown in FIG. 1, in a state of being attached to the corresponding circuit boards, respectively.

Figure 2:
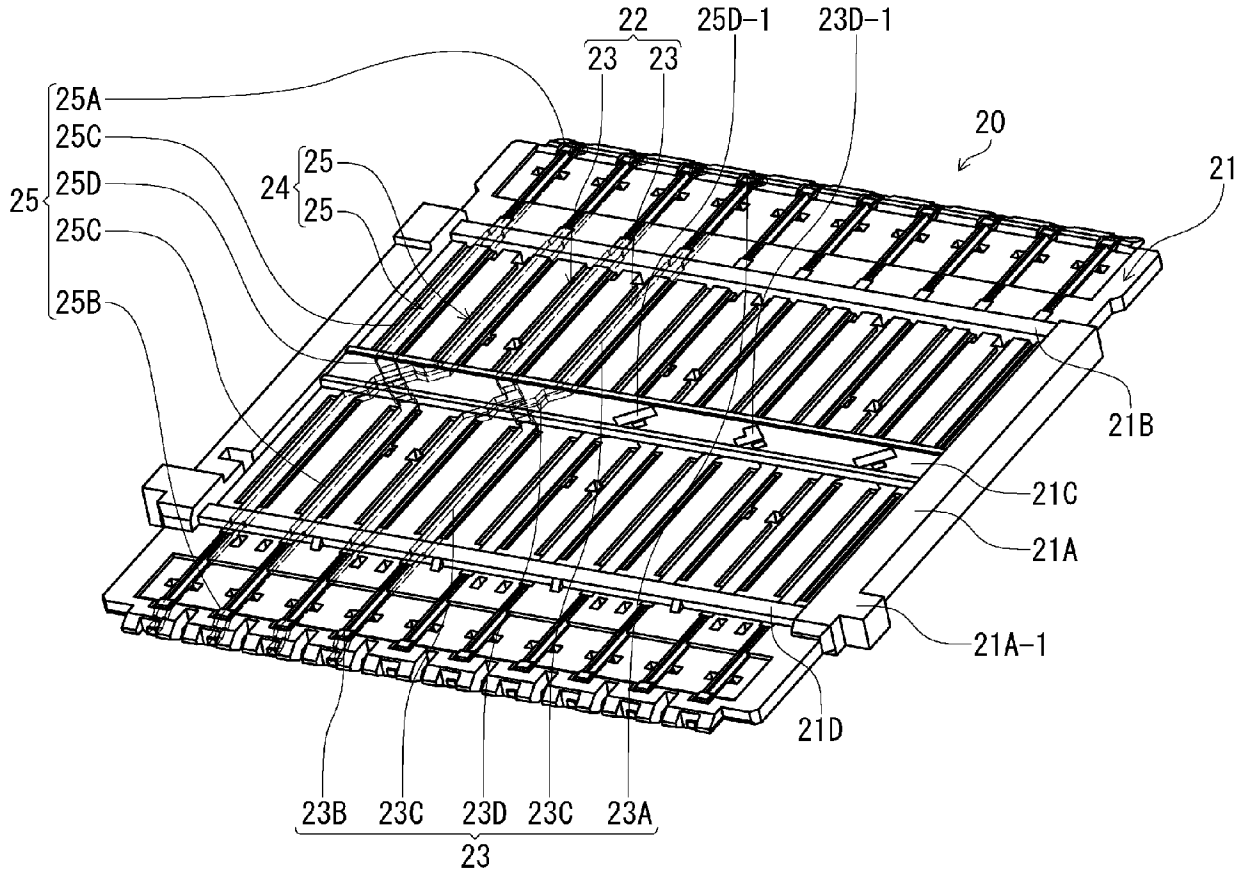
FIG. 2 is a perspective view showing the connection blade in FIG. 1, according to the first embodiment of the present invention.
Figure 3:
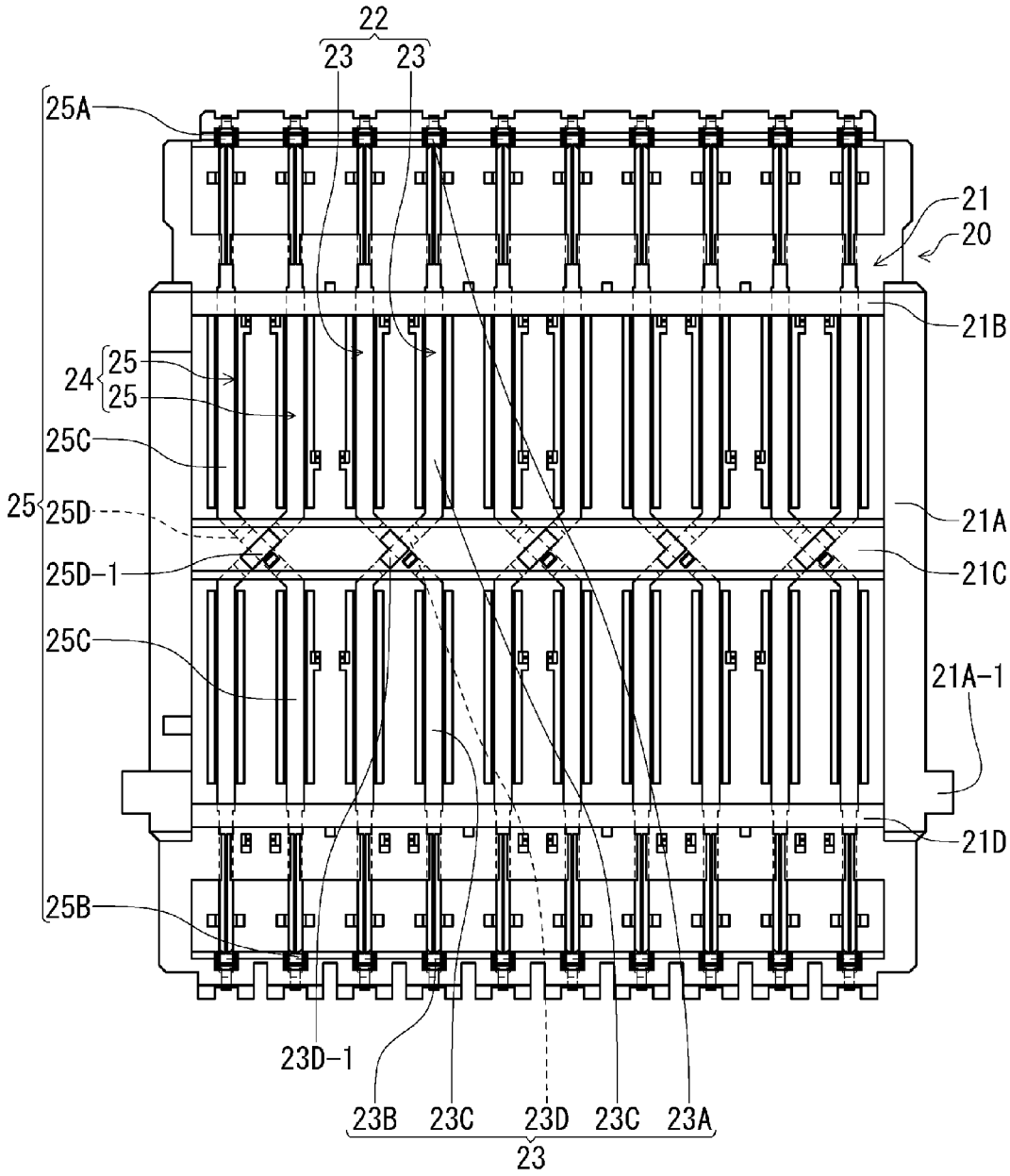
FIG. 3 is a plan view showing the connection blade in FIG. 2, according to the first embodiment of the present invention.

As shown in FIGS. 2 and 3, the connection blade 20 includes an insulation board 21 made from an electrical insulating material. On one of plate surfaces of the insulation board 21, the connection blade 20 holds a pair of elements 23 forming a straight pair as signal lines; and a pair of elements 25 forming a cross pair 24 as signal lines. On the other plate surface of the insulation board 21, a shield plate is provided. An explanation of the shield plate will be omitted since the shield plate does not relate to the subject matter of the present invention.

The insulation board 21 includes a guided edge portion 21A on both side edges thereof. The guided edge portion 21A is provided in order to insert the insulation board 21 into the insulation holding member 11 to be assembled. Further, the guided edge portion 21A includes a protruding portion 21A-1 for determining a position for the insertion. On the plate surface of the insulation board 21, elongated holding protrusions 21B, 21C and 21D are provided so as to connect the guided edge portions 21A situated on either end of the insulation board 21. The elongated holding protrusions 21B, 21C and 21D are arranged to have specific intervals. The elongated holding protrusions 21B, 21C and 21D hold the element 23 forming each of the signal lines of the straight pair 22 and the element 25 forming each of the signal lines of the cross pair 24. The element 23 and 25 extend between the guided edge portions 21A on the both side edges in a direction parallel with the guided edge portion 21A.

The straight pair 22 and the cross pair 24 are, for example, made by punching out then partially bending a metal sheet. Further, the straight pair 22 and the cross pair 24 are arranged alternately on the plate surface of the insulation board 21. Both of the straight pair 22 and the cross pair 24 extend in an extending direction of the guided edge portion 21A from one end to another of the insulation board 21 and include contact points 23A and 23B, and contact points 25A and 25B on the both ends thereof, respectively.

The elements 23 of the straight pair 22 form the same shape with the element 25 of the cross pair 24 on both sides of the elongated holding protrusion 21C, which is situated in the center of the insulation board 21 in the extending direction of the elements 23 and 25. More specifically, in a region described above, the element 23 of the straight pair 22 and the element 25 of the cross pair 24 extend in shape of parallel straight lines, thereby forming parallel sections 23C and 25C, respectively. The element 23 of the straight pair 22 and the element 25 of the cross pair 24 are held by integrally molding with the insulation board 21. One surface of the elements 23 and 25 are exposed in a region other than where the elongated holding protrusions 21B, 21C and 21D are situated. In a region where the elongated holding protrusions 21B and 21D are situated, the elements 23 and 25 are held by being buried in the insulation board 21. In a region where the elongated holding protrusion 21C is situated, one of the elements 23 of the straight pair 22 is partially exposed while the other of the elements 23 of the straight pair 22 is buried. Similarly, in the region where the elongated holding protrusion 21C is situated, one of the elements 25 of the cross pair 24 is partially exposed while the other of the elements 25 of the cross pair 24 is buried. Amount of such partial exposure of the elements 23 and 25 is determined according to coordination of impedance.

Figure 4:
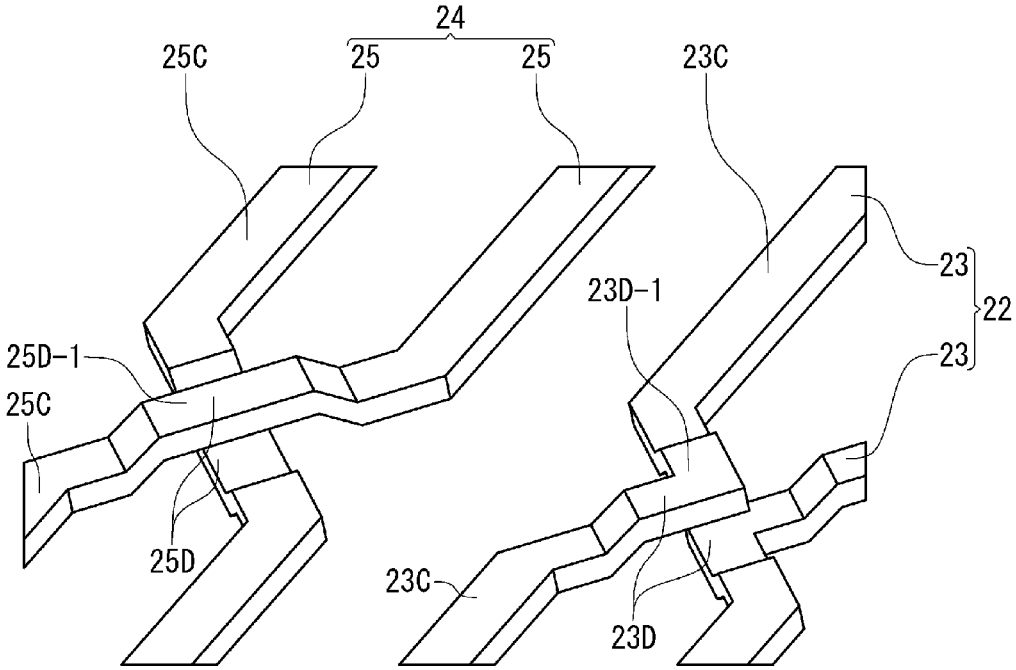
FIG. 4 is an enlarged perspective view partially showing the connection blade in FIGS. 2 and 3, according to the first embodiment of the present invention.

As shown in FIG. 4, in the region where the elongated holding protrusion 21C is situated, the pair of the elements 25 of the cross pair 24 form a crossing section 25D by being bent so as to intersect with each other as being viewed from a direction perpendicular to the insulation board 21.

On the other hand, the pair of the elements 23 of the straight pair 22 forms a quasi-crossing section 23D by being bent in a V-letter shape so as to be adjacent to each other. As being viewed from the direction perpendicular to the insulation board 21, the quasi-crossing section 23D appears as if the elements 23 of the pair intersect with each other.

In the crossing section 25D of the elements 25 of the cross pair 24, as shown in FIG. 4, the elements 25 intersect with each other in a X-letter shape as being viewed from the direction perpendicular to the insulation board 21. The elements 25 are also bent in a thickness direction thereof in the crossing section 25D, so as to have a space therebetween not to contact each other. The space between the elements 25 in the crossing section 25D is filled with a material same as a material of the insulation board 21. As shown in FIGS. 2 and 3, an element portion 25D-1 of one of the elements 25 which is situated in an upper position is exposed in the crossing section 25D.

On the other hand, the elements 23 of the straight pair 22 are bent in the V-letter shape so as to be adjacent to each other as being viewed from the direction perpendicular to the insulation board 21 and thereby form the quasi-crossing 23D in the region where the elongated holding protrusion 21C is situated. Therefore, though the elements 23 of the straight pair 22 do not actually intersect with each other, the elements 23 of the straight pair 22 appear to intersect with each other in the quasi-crossing section 23D since vertexes of both elements 23 thus bent are situated in the same position as being viewed from the direction perpendicular to the insulation board 21. The elements 23 are also bent in a thickness direction thereof in the quasi-crossing section 23D, so as to have a space therebetween not to contact each other. Similar to the cross pair 24, the space between the elements 23 in the quasi-crossing section 23D is filled with the material same as the material of the insulation board 21. As shown in FIGS. 2 and 3, an element portion 23D-1 of one of the elements 23 which is situated in an upper position is exposed in the quasi-crossing section 23D.

Accordingly, the cross pair 24 composed of the pair of the elements 25 and the straight pair 22 composed of the pair of the elements 23 have the same shape with each other as being viewed from the direction perpendicular to the surface of the insulation board 21, not only in the parallel sections 23C and 25C, but also in the crossing section 23D and the quasi-crossing section 25D, respectively.

Therefore, the element 25 of the cross pair 24 and the element 23 of the straight pair 22 have the same path length since the cross pair 24 and straight pair 22 apparently have the same shape. Accordingly, both of the cross pair 24 and the straight pair 22 function as differential pair circuits as well as minimizing difference of the impedance therebetween. Further, it is possible to share a molding for punching out the elements of the pairs, at least in the parallel section. It also enables to obtain a molding for the integrated molding with a lower cost by sharing and simplifying a shape thereof. Furthermore, it is possible to narrow a space between the straight pair and cross pair, since both of the straight pair and the cross pair are able to have the same shape in the parallel sections thereof. Therefore, the connection blade is able to be downsized in a direction of the space described above.

Second embodiment

In the embodiment shown in FIGS. 1 to 4, the elements of both of the cross pair and the straight pair extend in the same direction, being parallel with one straight line. In the present invention, not limited to the embodiment described above, each of the elements of the cross pair and the straight pair may have a L-letter shape by being bent as a whole in a substantial right angle, as shown in FIG. 5.

Figure 5:
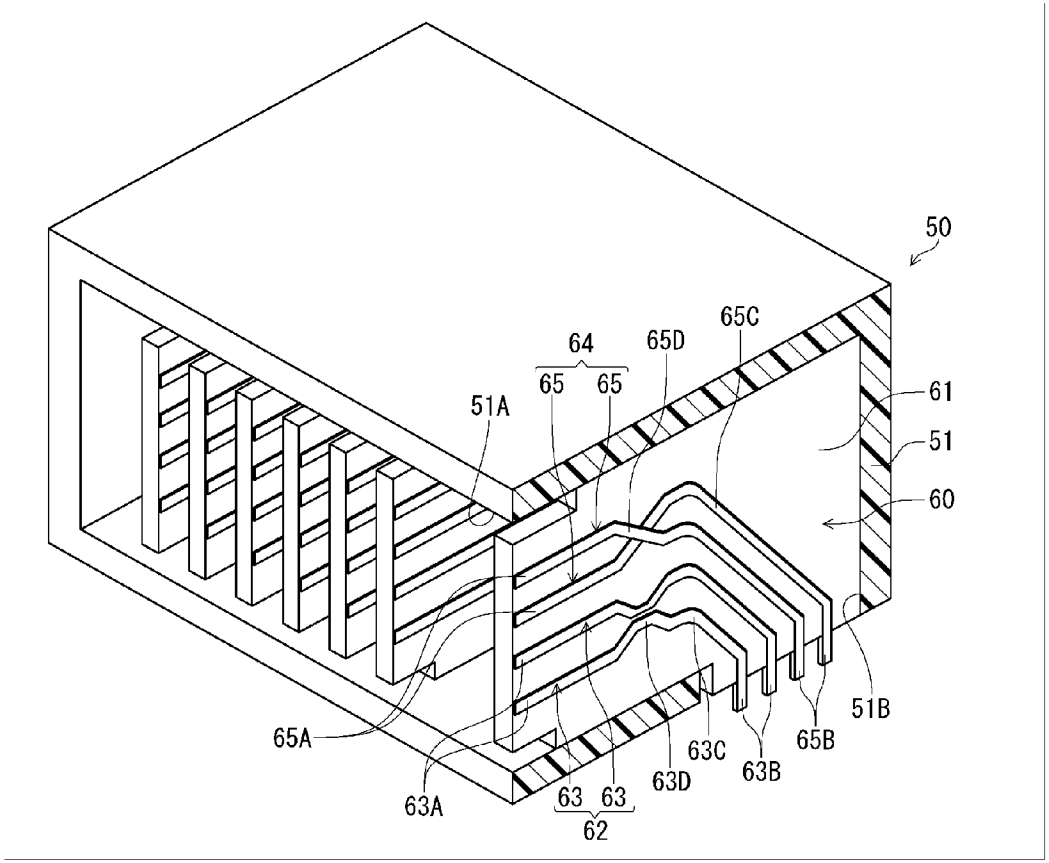
FIG. 5 is a broken enlarged perspective view showing an intermediate connection electrical connector according to a second embodiment of the present invention.

As shown in FIG. 5, an intermediate connection electrical connector 50 includes an insulation holding member 51 utilized as a housing and a plurality of a connection blades 60. The insulation holding member 51 includes openings 51A and 51B opening toward a side direction and the lower direction, respectively. The connection blade 60 includes an insulation board 61. The insulation board 61 includes a pair of elements 63 as a straight pair 62 thereon. The straight pair 62 includes contact points 63A and 63B where the openings 51A and 51B are provided, respectively. The straight pair 62 further includes a parallel section 63C and a quasi-crossing section 63D. Similarly, the insulation board 61 includes a pair of elements 65 as a cross pair 64 thereon. The cross pair 64 includes contact points 65A and 65B where the openings 51A and 51B are provided, respectively. Further, the cross pair 64 includes a parallel section 65C and a crossing section 65D. In the embodiment, both of the straight pair 62 and the cross pair 64 have the substantial L-letter shapes overall. Further, the straight pair 62 is situated an inner side of the substantial L-letter shape, thereby having a path length shorter than the cross pair 64. Furthermore, elements 65 forming the cross pair 64 have different path lengths from each other since the cross pair 64 forms overall the substantial L-letter shape. Similarly, elements 63 forming the straight pair 62 have different path lengths from each other since the straight pair 62 forms overall the substantial L-letter shape.

In the connection blade 60 shown in FIG. 5, the elements 63 of the straight pair 62 come close to each other by being bent into a V-letter shape in the quasi-crossing section 63D but do not intersect with each other as being viewed from a direction perpendicular to the insulation board 61. Therefore, the elements 63 do not contact each other in the quasi-crossing section 63D though not being bent in a thickness direction thereof. Although the elements 63 do not intersect with each other, the elements 63 appear to intersect each other since the elements 63 come close to each other in the quasi-crossing section 63D. In the embodiment, the elements 63 and 65 are bent into the L-letter shape as being parallel with each other. Therefore, each element has a different path length. The intermediate connection electrical connector 50 having a configuration described above is not used alone.

Figure 6:
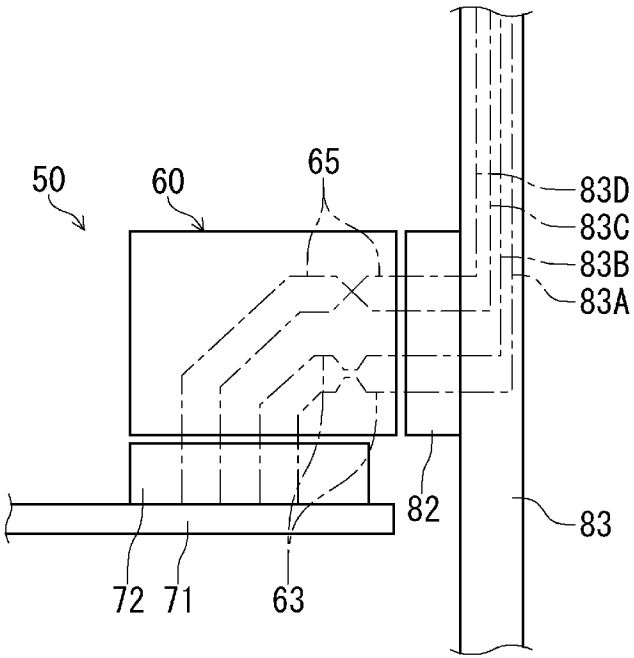
Figure 6:
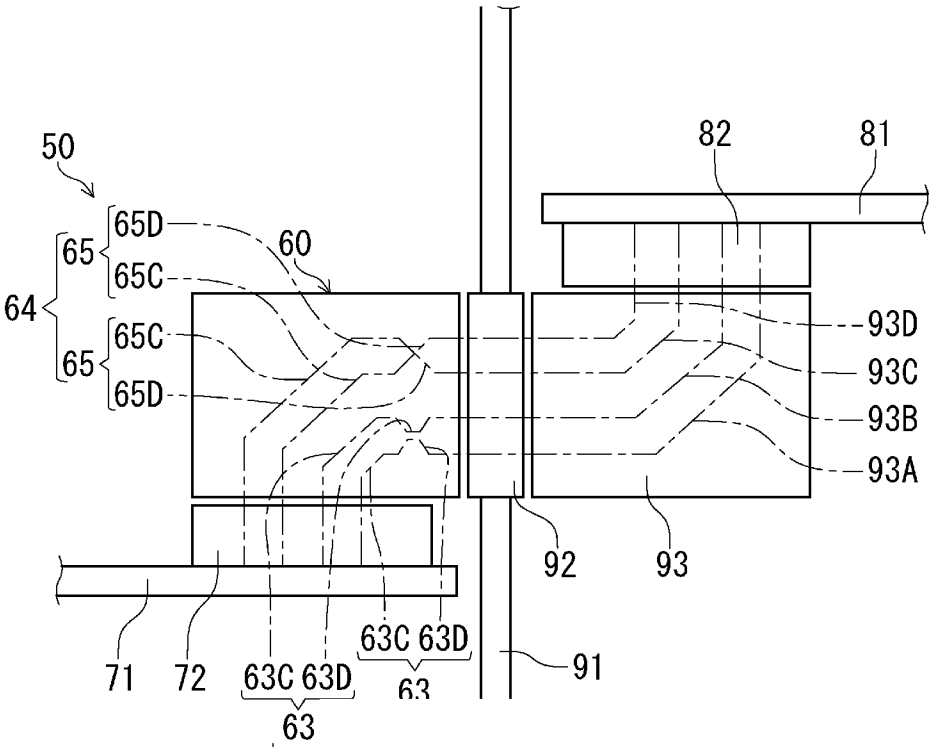

As shown in FIGS. 6(A) and 6(B), the intermediate connection electrical connector 50 is used as a connection blade assembly, connected to other circuit connection portion. FIGS. 6(A) and 6(B) schematically show wire paths or elements of the straight pair 62 and the cross pair 64 with dashed lines.

In FIG. 6(A), the intermediate connection electrical connector 50 having the connection blade 60 is connected to a first connector 72 mounted on a first mounting board 71 as a circuit connection portion and a second connector 82 mounted on a second mounting board 81 as a circuit connection portion through a relaying connector 92 provided on a relaying board 91 as a circuit connection portion and a relaying connection blade 93.

The first connector 72, the second connector 82, the relaying connector 92 and the relaying connection blade 93 include only wire paths for connecting in series to the elements 63 and 65 of the straight pair 62 and the cross pair 64 of the connection blade 60 of the intermediate connection electrical connector 50, and the wire paths thereof simply form extended wire paths without intersecting with each other. Especially, in the relaying connection blade 93, elements 93A, 93B, 93C and 93D to be connected respectively to the elements 63 and 65 of the straight pair 62 and the cross pair 64 of the connection blade 60 of the intermediate connection electrical connector 50 are bent into a L-letter shape in parallel without intersecting with each other. The elements 63 of the straight pair 62 having the relatively shorter wire paths of the connection blade 60 is connected to the elements 93A and 93B of the relaying connection blade 93. The elements 93A and 93B have the relatively longer wire paths. Further, the elements 65 of the cross pair 64 having the relatively longer wire paths of the connection blade 60 is connected to the elements 93C and 93D of the relaying connection blade 93. The elements 93C and 93D have the relatively shorter wire paths. Being relayed by the relaying connection blade 93, path lengths of all of the four wire paths between the first mounting board 71 and the second mounting board 81 are adjusted to be equal. Accordingly, a differential pair circuit of the intermediate connection electrical connector 50 is able to function.

In FIG. 6(B), the intermediate connection electrical connector 50 is connected to the first connector 72 mounted the first mounting board 71 and the second connector 82 mounted on another board 83 so-called a backplane. In FIG. 6(B), the intermediate connection electrical connector 50, the first mounting board 71, the first connector 72, and the second connector 82 are the same as components having the same numerical references in FIG. 6(A).

In FIG. 6(B), the path lengths of the four wire paths between the first mounting board 71 and the another board 83 are adjusted in the another board 83. As shown in FIG. 6(B), the another board 83 includes four wire paths 83A, 83B, 83C and 83D formed therein so as to form layers. Similar to the elements 93A, 93B, 93C and 93D of the relaying connection blade 93 shown in FIG. 6(A), the wire paths 83A, 83B, 83C and 83D have different lengths from each other so that each path has the same length from the first mounting board 71 to the another board 83.

In the present invention, the crossing section of the cross pair and the quasi-crossing section of the straight pair are not necessarily situated in the same position in the extending direction of the wire path. The crossing section of the cross pair and the quasi-crossing section of the straight pair may be situated in different positions in the direction described above.

Figure 7:
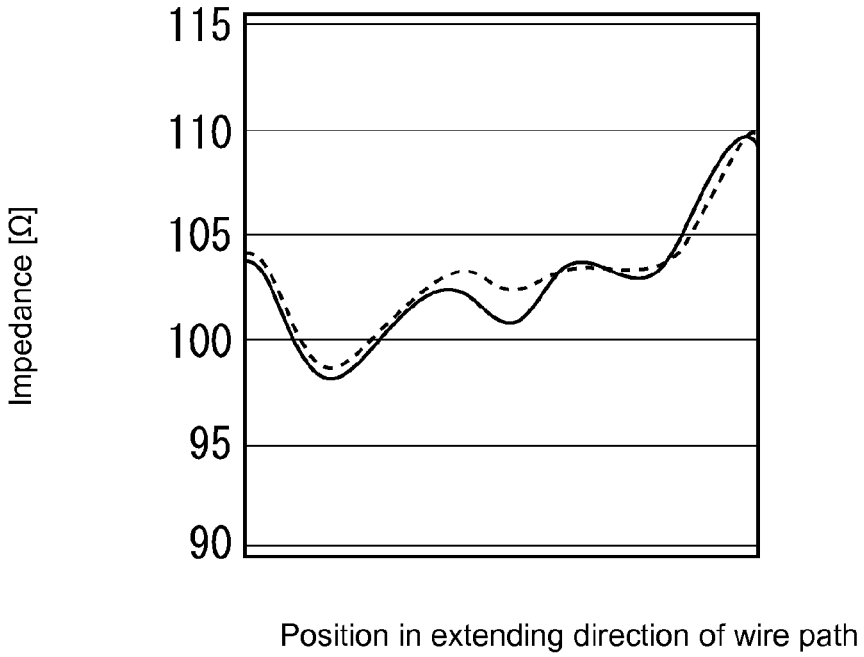
Figure 7:
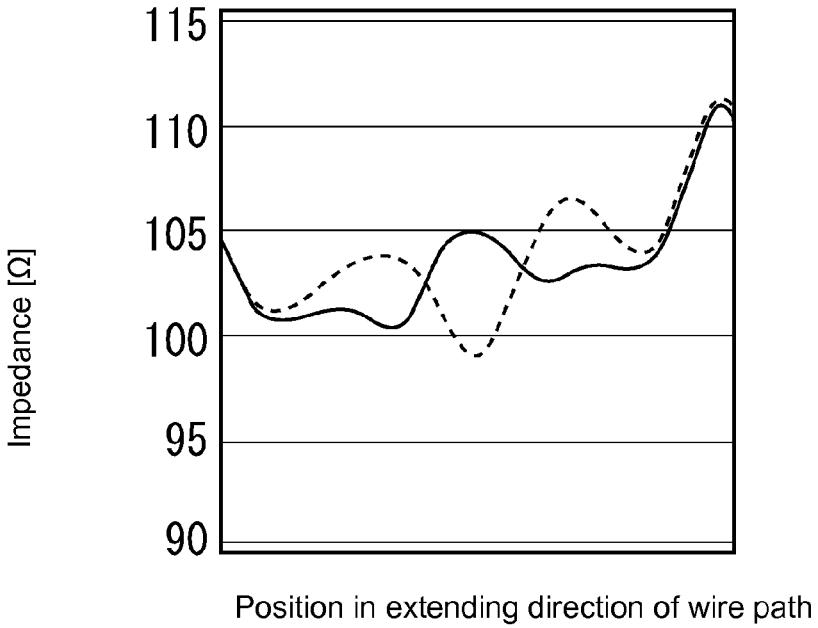

Next, test results of the present invention against a conventional example will be explained. In the test, the difference of the impedance between a cross pair and a straight pair formed on a connection blade is measured. In an example according to the present invention, the connection blade including the cross pair and the straight pair shown in FIGS. 1 to 3 is used while in a comparative example the connection board including the cross pair and the straight pair with a wavy shape according to Patent Reference is used. FIG. 7(A) shows a measurement result of the example according to the present invention while FIG. 7(B) shows a measurement result of the comparative example. In each of FIGS. 7(A) and 7(B), a vertical axis indicates respective values of the impedance [Ω] of the cross pair and the straight pair and a horizontal axis indicates positions of both of the cross pair and the straight pair in the extending direction of the wire path. Further, in each of FIGS. 7(A) and 7(B), the impedance of the straight pair is shown in a solid line and the impedance of the cross pair is shown in a dashed line. As shown in FIG. 7(A) and FIG. 7(B), it is clear that the difference of the impedance is reduced in the example according to the present invention compare to the comparative example.

The disclosure of Japanese Patent Application No. 2011-220723 filed on Oct. 5, 2011, is incorporated in the application by reference.

While the invention has been explained with reference to the specific embodiments of the invention, the explanation is illustrative and the invention is limited only by the appended claims.

What is claimed is:

1. A connection blade for connecting at least two circuit connection portions, comprising:

an insulation board;

a straight pair formed on the insulation board and including a first wire path and a second wire path, said straight pair further including a quasi-crossing section where the first wire path approaches the second wire path; and a cross pair formed on the insulation board and including a third wire path and a fourth wire path, said cross pair further including a crossing section where the third wire path crosses over the fourth wire path in a non-contact manner, said crossing section having a shape the same as that of the quasi-crossing section viewed in a direction perpendicular to the insulation board.

2. The connection blade according to claim 1, wherein said straight pair further includes a first contact point to be contact with one of the circuit connection portions and a second contact point to be contact with the other of the circuit connection portions, and said cross pair further includes a third contact point to be contact with one of the circuit connection portions and a fourth contact point to be contact with the other of the circuit connection portions.

3. The connection blade according to claim 2, wherein said straight pair has a length between the first contact point and the second contact point the same as that of the cross pair between the third contact point and the fourth contact point.

4. The connection blade according to claim 1, wherein said straight pair further includes a parallel section where the first wire path extends in parallel to the second wire path so that the first wire path has a first curved portion approaching the second wire path and the second wire path has a second curved portion approaching the first wire path in the quasi-crossing section.

5. The connection blade according to claim 4, wherein said straight pair includes the quasi-crossing section where the first wire path does not contact with the second wire path, and said straight pair is configured so that a vertex of the first curved portion is situated at a position over that of the second curved portion viewed in the direction perpendicular to the insulation board.

6. An intermediate connection electrical connector, comprising the connection blade according to claim 1, and an insulation holding member for holding the connection blade.

7. A connection blade assembly, comprising:

at least two circuit connection portions;

a connection blade for connecting the circuit connection portions; and an insulation holding member for holding the connection blade, wherein said connection blade includes, an insulation board;

a straight pair formed on the insulation board and including a first wire path and a second wire path, said straight pair further including a quasi-crossing section where the first wire path approaches the second wire path; and a cross pair formed on the insulation board and including a third wire path and a fourth wire path, said cross pair further including a crossing section where the third wire path crosses over the fourth wire path in a non-contact manner, said crossing section having a shape the same as that of the quasi-crossing section viewed in a direction perpendicular to the insulation board.

8. The connection blade assembly according to claim 7, wherein said straight pair further includes a first contact point to be contact with one of the circuit connection portions and a second contact point to be contact with the other of the circuit connection portions, and said cross pair further includes a third contact point to be contact with one of the circuit connection portions and a fourth contact point to be contact with the other of the circuit connection portions.

9. The connection blade assembly according to claim 8, wherein said straight pair has a length between the first contact point and the second contact point the same as that of the cross pair between the third contact point and the fourth contact point.

10. The connection blade assembly according to claim 7, wherein said straight pair further includes a parallel section where the first wire path extends in parallel to the second wire path so that the first wire path has a first curved portion approaching the second wire path and the second wire path has a second curved portion approaching the first wire path in the quasi-crossing section.

11. The connection blade according to claim 10, wherein said straight pair includes the quasi-crossing section where the first wire path does not contact with the second wire path, and said straight pair is configured so that a vertex of the first curved portion is situated at a position over that of the second curved portion viewed in the direction perpendicular to the insulation board.

12. The connection blade assembly according to claim 8, wherein said first contact point is connected to a first wiring portion of the one of the circuit connection portions and the second contact point is connected to a second wiring portion of the other of the circuit connection portions, said third contact point is connected to a third wiring portion of the one of the circuit connection portions and the fourth contact point is connected to a fourth wiring portion of the other of the circuit connection portions so that a total length of the first wiring portion, the second wiring portion, and the straight pair becomes substantially equal to that of the third wiring portion, the fourth wiring portion, and the cross pair.

* * * * *